US006547356B2

(12) United States Patent
Edelen et al.

(10) Patent No.: US 6,547,356 B2
(45) Date of Patent: Apr. 15, 2003

(54) LATCHING SERIAL DATA IN AN INK JET PRINT HEAD

(75) Inventors: John Glenn Edelen, Versailles, KY (US); Kristi Maggard Rowe, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/780,555

(22) Filed: Feb. 9, 2001

(65) Prior Publication Data

US 2002/0109739 A1 Aug. 15, 2002

(51) Int. Cl.[7] ..... B41J 29/38

(52) U.S. Cl. ..... 347/12; 347/237; 347/247; 347/211; 347/168

(58) Field of Search ..... 347/12, 211, 247, 347/237, 225, 168, 9.4

(56) References Cited

U.S. PATENT DOCUMENTS

| | | | | | |
|---|---|---|---|---|---|
| 3,064,889 | A | | 11/1962 | Hupp | |
| 4,002,834 | A | * | 1/1977 | Cocci et al. | 178/69.1 |
| 4,051,538 | A | | 9/1977 | Fox et al. | |
| 4,063,254 | A | | 12/1977 | Fox et al. | |
| 4,203,030 | A | | 5/1980 | Moran | |
| 4,638,329 | A | | 1/1987 | Nakayama et al. | |
| 4,815,111 | A | | 3/1989 | Wakimoto | |
| 4,876,704 | A | | 10/1989 | Ozaki | |
| 5,300,968 | A | | 4/1994 | Hawkins | |
| 5,412,406 | A | | 5/1995 | Fujimoto | |
| 5,440,304 | A | * | 8/1995 | Hirai | 341/100 |
| 5,548,688 | A | | 8/1996 | Wiklof et al. | |
| 5,664,153 | A | * | 9/1997 | Farrell | 711/154 |
| 5,790,140 | A | | 8/1998 | Koizumi et al. | |
| 5,877,784 | A | * | 3/1999 | Maru et al. | 347/12 |
| 6,003,970 | A | | 12/1999 | Fujita et al. | |
| 6,130,692 | A | | 10/2000 | Mochizuki et al. | |
| 6,144,326 | A | * | 11/2000 | Krone et al. | 341/118 |

* cited by examiner

*Primary Examiner*—John Barlow
*Assistant Examiner*—Lam Nguyen
(74) *Attorney, Agent, or Firm*—Luedeka, Neely & Graham; Jacqueline M. Daspit

(57) ABSTRACT

A print data loading circuit receives N bits of serial data on a serial input data line, and provides the input data to a data bus in an addressing circuit for addressing one or more image-forming elements in a printing device. The data loading circuit includes an N-bit serial shift register having N number of serially-coupled single-bit storage registers. The data loading circuit also includes N−1 number of data latches, each having a data input coupled to a data output of a corresponding one of the single-bit storage registers. The data outputs of the data latches are coupled to N−1 number of selection lines that are coupled to the data bus. Each data latch has a clock input that is coupled to the data output of the Nth storage register. Based on this configuration, a bit provided at the Nth-register data output acts as a load trigger bit to cause the other data bits in the other single-bit storage registers to be loaded into the N−1 number of data latches. By providing the trigger bit from the Nth register of the shift register, the present invention eliminates the need for a second clock input to latch the print data into the data latches. Eliminating a second clock input reduces print head costs and potential EMI problems.

9 Claims, 4 Drawing Sheets

LATCHING SERIAL DATA IN AN INK JET PRINT HEAD

FIELD OF THE INVENTION

The present invention is generally directed to ink jet print heads. More particularly, the invention is directed to a circuit for transferring serial print data onto a data bus in a print head chip.

BACKGROUND OF THE INVENTION

The manufacturing costs of ink jet print heads and print head cartridges is significantly affected by the number of signal lines that must pass from the print head chip to the TAB circuit on which the chip is mounted on the print head cartridge, and front the print head cartridge to the printer. Besides cost, high frequency clock and data input/output (I/O) lines tend to introduce electromagnetic interference which must be accounted for in the design of cabling that connects the printer and the print head cartridge. Thus, ways to reduce the number of clock and I/O signal lines between the chip and TAB circuit, and between the printer and the print head cartridge, are constantly being sought by print head designers.

SUMMARY OF THE INVENTION

The present invention addresses the above needs by providing a print data loading circuit for receiving at least N bits of serial data on a serial input data line, where at least some of the serial data describes an image to be formed on a print medium by a printing device. The loading circuit provides the data to a data bus in an addressing circuit for addressing one or more image-forming elements in the printing device. The loading circuit includes a serial shift register having N number of single-bit storage registers, including a first single-bit storage register, an Nth single-bit storage register, and N−2 number of single-bit storage registers serially coupled between the first and Nth single-bit storage registers. The first storage register has a first-register data output, a first-register data input coupled to the serial input data line, and a first-register clock input coupled to a clock line. The Nth storage register has an Nth-register data input, an Nth-register data output, and an Nth-register clock input coupled to the clock line. The data loading circuit also includes N−1 number of data latches, each having a data-latch input, a data-latch output, and a data-latch clock input. The data-latch inputs of the data latches are coupled to the data outputs of the first single-bit storage register and the N−2 number of single-bit storage registers serially coupled between the first and Nth single-bit storage registers. The data-latch outputs are coupled to the N−1 number of selection lines that are coupled to the data bus. The data-latch clock inputs of the data latches are coupled to the Nth-register data output.

Based on this configuration, a data bit transferred from the Nth-register data output to the data-latch clock inputs acts as a load trigger bit to cause at least some of the other data bits in the other single-bit storage registers to be loaded into the N−1 number of data latches. By providing the trigger bit from the Nth register of the shift register, the present invention eliminates the need for a second clock input to latch the print data into the data latches. Eliminating a second clock input reduces print head costs and potential EMI problems.

In another aspect, the invention provides a method for sending print data to an ink droplet generator addressing circuit in an ink jet print head. The method includes shifting N−1 of N number of bits of serial input data into an N-bit serial shift register, where a first bit of the N number of bits is a load trigger bit. The method also includes shifting an Nth bit of the N number of bits into the shift register at a first time, thereby causing the load trigger bit to be shifted into an Nth register of the shift register. At a second time, the load trigger bit is provided from the Nth register of the shift register to clock inputs of N−1 number of data latches. The N−1 number of data latches are then loaded with the N−1 number of bits of data residing in the shift register when the load trigger bit is provided to the clock inputs of the data latches. The method further includes providing the N−1 number of bits of data from the N−1 number of data latches to the ink droplet generator addressing circuit.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF THE INVENTION

Figure 1:
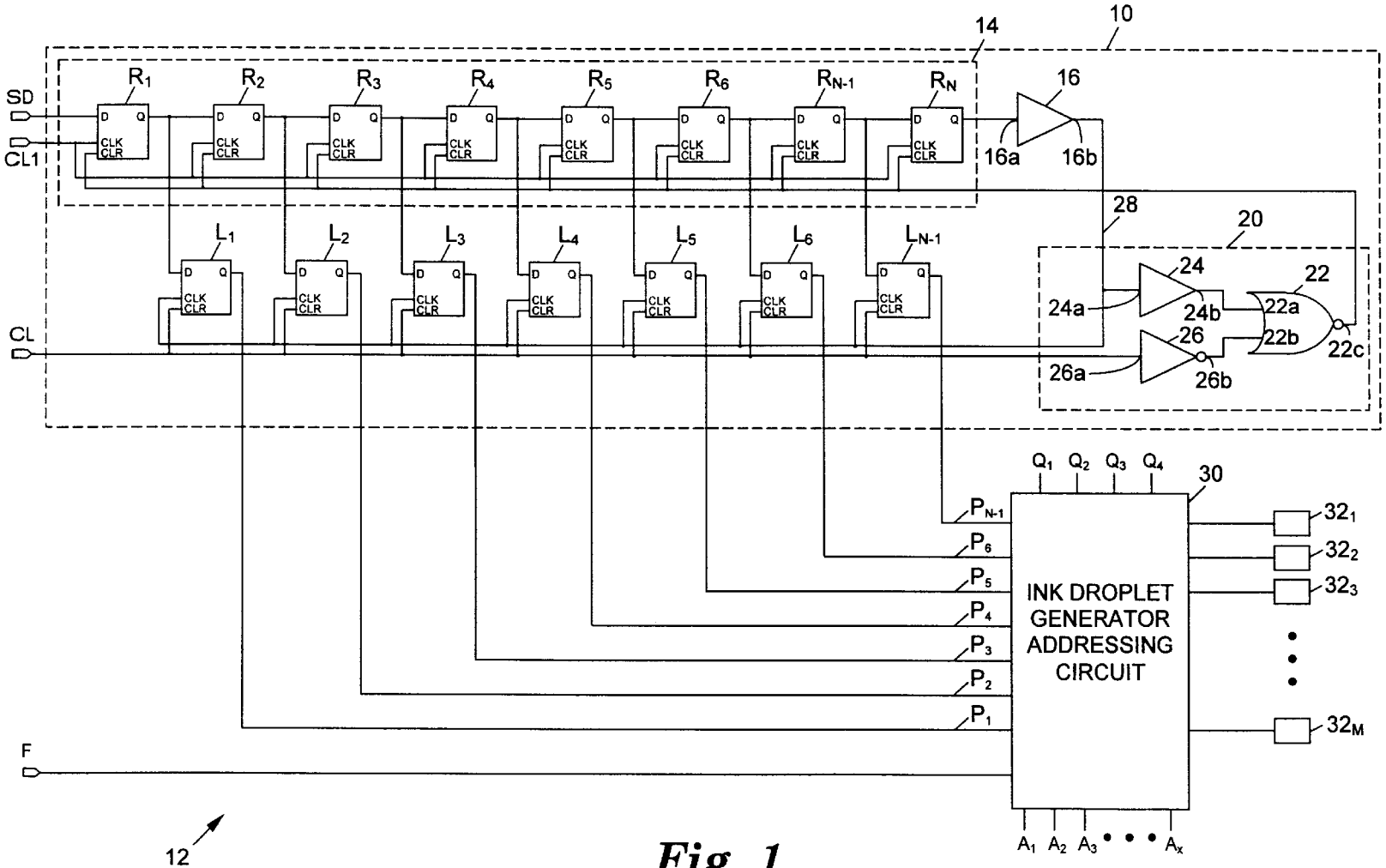
FIG. 1 is a functional block diagram of an ink jet print head having a print data loading circuit according to a preferred embodiment of the invention.
Figure 2:
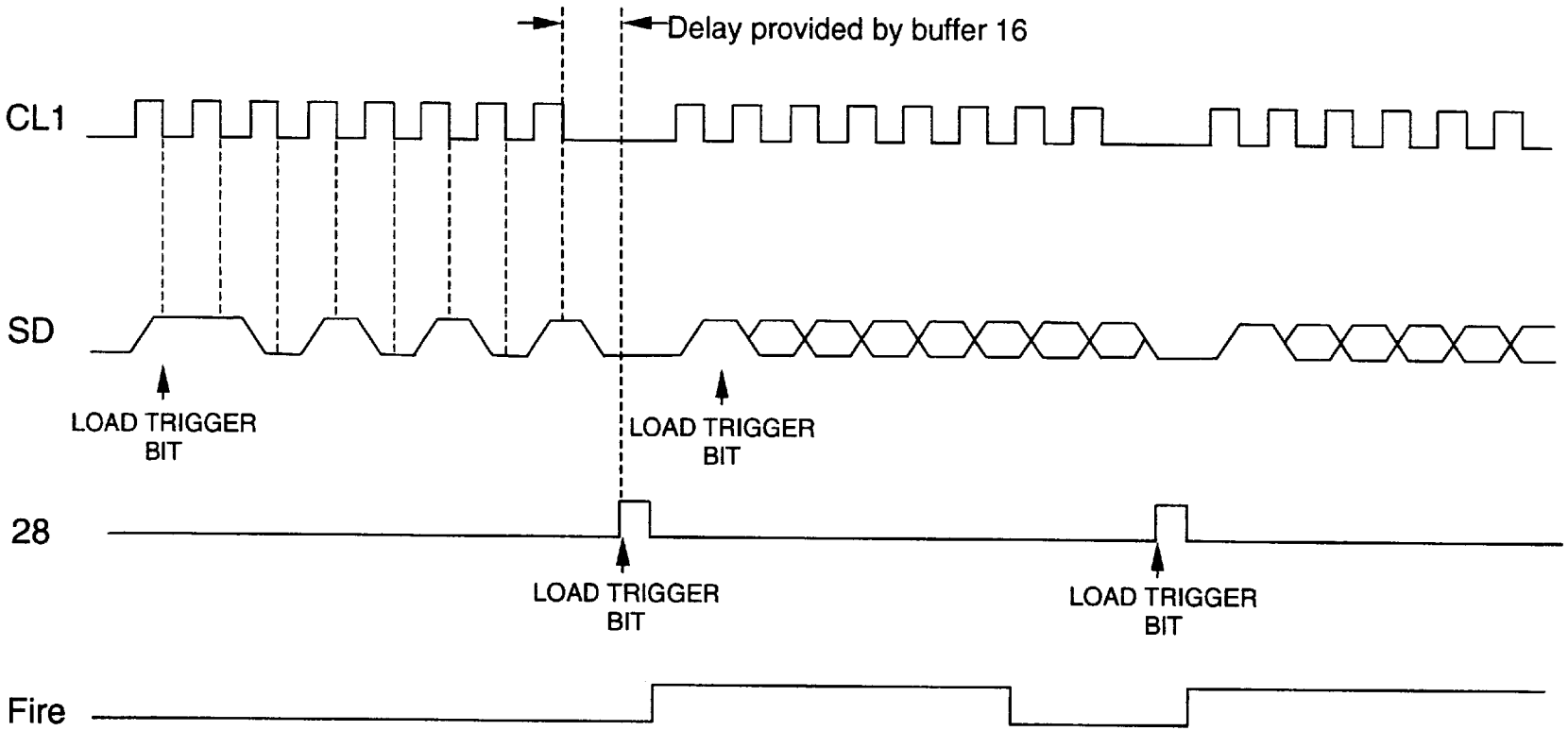
FIG. 2 is a timing diagram of the operation of a print data loading circuit according to a preferred embodiment of the invention.

Shown in FIG. 1 is a print data loading circuit 10 in an ink jet print head 12. The loading circuit 10 receives serial print data on a serial data line SD, where the serial print data describes an image to be printed by the print head 12 on a print medium. The loading circuit 10 also receives a clock signal on a clock line CL1 and a clear signal on a clear line CL. The purpose and function of these signals are described in more detail below.

The loading circuit 10 includes a serial shift register 14 consisting of N number of single-bit storage registers $R_1$–$R_N$, such as D, S-R, or J-K flip-flop circuits. In the preferred embodiment shown in FIG. 1, each bit register $R_1$–$R_N$ has a data input D, a data output Q, a clock input CLK, and a clear input CLR. To form the serial shift register 14, the data input D of each of the bit registers $R_2$–$R_N$ is connected to the data output Q of the adjacent preceding bit register $R_1$–$R_{N-1}$. As shown in FIG. 1, the data input of the bit register $R_1$ is preferably connected to the serial data line SD. The clock inputs CLK of each of the bit registers $R_1$–$R_N$ is preferably connected to the clock line CL1.

The loading circuit 10 of the preferred embodiment further includes N−1 number of data latches $L_1$–$L_{N-1}$, each having a data input D, a data output Q, a clock input CLK, and a clear input CLR. As shown in FIG. 1, the data input D of each of the data latches $L_1$–$L_{N-1}$ is connected to the data output Q of a corresponding one of the bit registers $R_1$–$R_{N-1}$. The data output Q of each of the data latches $L_1$–$L_{N-1}$ is preferably coupled to a corresponding one of N−1 selection signal lines, such as primitive signal lines $P_1$–$P_{N-1}$. The clear inputs CLR of each of the data latches $L_1$–$L_{N-1}$ is preferably connected to the clear line CL.

With continued reference to FIG. 1, the data output Q of the Nth bit register $R_N$ is preferably connected to an input 16*a* of a first buffer circuit 16. In the preferred embodiment, the first buffer circuit 16 provides a time delay between its input 16*a* and its output 16*b*, the purpose of which is described in more detail below. Although the buffer circuit 16 is depicted in FIG. 1 as a single element, one skilled in the art will appreciated that the buffer circuit 16 could comprise a serial chain of several delay circuits, such as four. The output 16*b* of the first buffer circuit 16 is provided to the clock inputs CLK of the N−1 number of data latches $L_1$–$L_{N-1}$, and to the input 24*a* of a second buffer circuit 24.

The second buffer circuit 24 is part of a logic circuit 20, which also comprises a logic inverter 26 and a NOR gate 22. As shown in FIG. 1, the output 24*b* of the second buffer 24 is preferably connected to a first input 22*a* of the NOR gate. The input 26*a* of the inverter 26 is connected to the clear line CL, and the output 26*b* of the inverter 26 is connected to a second input 22*b* of the NOR gate. The output 22*c* of the NOR gate 22 is preferably coupled to the clear inputs CLR of each of the N number of bit registers $R_1$–$R_N$.

As depicted in FIG. 1, the print head 12 also includes M number of ink droplet generators $\mathbf{32}_1$–$\mathbf{32}_M$, such as resistive heaters or piezoelectric elements which, when activated, cause ejection of ink droplets from an associated ink chamber through a corresponding ink nozzle. Preferably, the generators $\mathbf{32}_1$–$\mathbf{32}_M$ are selectively activated by an ink droplet generator addressing circuit 30 based at least in part on selection signals, such as primitive signals, on the selection lines, such as the primitive lines $P_1$–$P_{N-1}$. In a preferred embodiment, the addressing circuit 30 is a 3-dimensional design, which selects the generators $\mathbf{32}_1$–$\mathbf{32}_M$ to be activated during each firing window based on primitive signals on the primitive lines $P_1$–$P_{N-1}$, address signals on address lines $A_1$–$A_X$, and quad signals on quad lines $Q_1$–$Q_4$. For example, if there were eight primitive lines $P_1$–$P_8$, sixteen address lines $A_1$–$A_{16}$, and four quad lines $Q_1$–$Q_4$, then up to 512 generators $\mathbf{32}_1$–$\mathbf{32}_{512}$ (M=8×16×4=512) would be selectable. During the firing window, a fire signal is provided on a fire input line F to activate the selected ones of the drop generators $\mathbf{32}_1$–$\mathbf{32}_M$ to eject an ink droplet.

One skilled in the art will appreciate that the data loading circuit 10 of the present invention could be used to load selection signals from a serial data stream onto primitive lines or address lines or both, or onto other selection lines in other multiple-dimension addressing schemes. Thus, the invention is not limited to loading a particular type of selection signal, but may be implemented to load any type of selection data onto an internal address bus in an address logic device, such as the addressing circuit 30.

A preferred method of operation of the data loading circuit of FIG. 1 will next be described with reference to FIGS. 2 and 3A–I. Preferably, print data describing which drop generators are selected during the firing window is provided to the print head 10 in a serial data stream that is partitioned into print data segments 40, with each segment including N number of data bits. N−1 number of the data bits in each segment 40 are print data bits, and one bit is a load trigger bit. According to the method described below, the print data bits are ultimately loaded onto an internal bus in the addressing circuit 30 to control selection of particular ones of the droplet generators $\mathbf{32}_1$–$\mathbf{32}_M$. In the preferred embodiment, the load trigger bit, also referred to herein as the Nth bit of the segment, is the first bit in the segment to be shifted into the shift register 14. According to the preferred embodiment of the invention, the load trigger bit is always one.

Figure 3A:
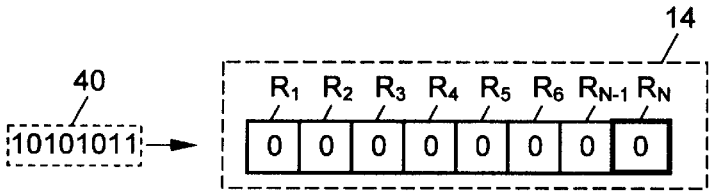
FIGS. 3A–I depict a sequence of operations for loading print data according to a preferred embodiment of the invention.
Figure 3B:
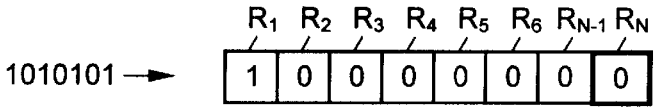
Figure 3C:
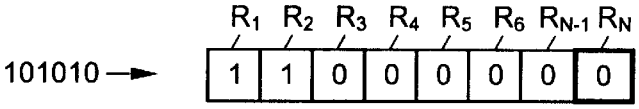
Figure 3D:
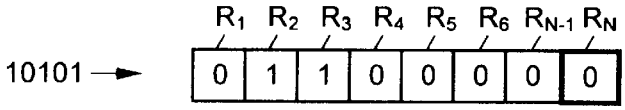
Figure 3E:
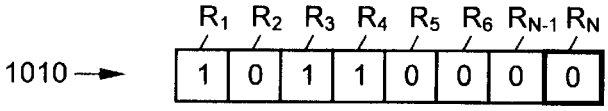
Figure 3F:
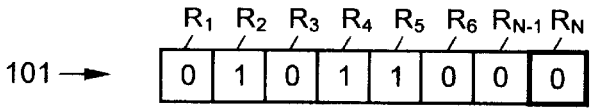
Figure 3G:
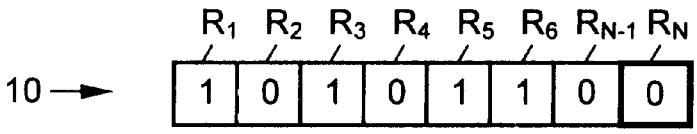
Figure 3H:
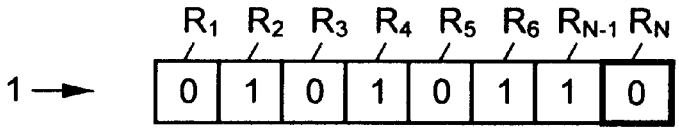
Figure 3I:
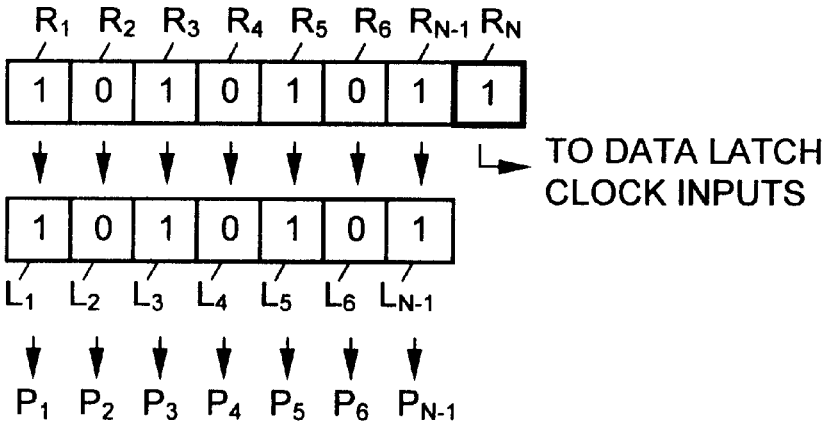

As depicted in FIG. 3A, an example 8-bit data segment 40 includes the bits "10101011", where the load trigger bit is the right-most bit in the segment 40. Prior to loading the data segment 40 into the register 14, each bit in the register 14 is cleared by setting each bit to zero. As shown in the timing diagram of FIG. 2, the data segment 40 is shifted bit-by-bit into the register 14 as eight clock pulses are applied on the clock line CL1 to the clock inputs CLK of the bit registers $R_1$–$R_N$. FIGS. 3B–3I depict the shifting of the data bits through the registers $R_1$–$R_N$. At the eighth clock pulse, the load trigger bit, which is preferably a one, is shifted into the Nth bit register $R_N$, setting the output Q of the register $R_N$ to a logical high state. After a delay provided by the first buffer circuit 16, the output 16*b* of the buffer circuit 16 on the line 28 goes high. The timing of the load trigger bit on the line 28 is also depicted in the timing diagram of FIG. 2.

Since the line 28 is connected to the clock inputs CLK of the data latches $L_1$–$L_{N-1}$, the load trigger bit is provided to the data latches $L_1$–$L_{N-1}$ at some delay time after the load trigger bit is shifted into the bit register $R_N$. In the preferred embodiment of the invention, the time delay provided by the buffer circuit 16 is generally just long enough for the states of the flip-flops of the registers $R_1$–$R_N$ to settle, which is typically a few nanoseconds. Upon receipt of the delayed load trigger bit at the clock inputs CLK, the data latches $L_1$–$L_{N-1}$ are triggered to load the print data bits from the outputs Q of the bit storage registers $R_1$–$R_{N-1}$ to the inputs D of the data latches $L_1$–$L_{N-1}$. The print data bits then appear at the outputs Q of the data latches $L_1$–$L_{N-1}$ and on the corresponding selection signal lines $P_1$–$P_{N-1}$ which are connected to the internal bus of the addressing circuit 30. After the print data bits are loaded onto the internal bus of the addressing circuit 30, a fire signal on the line F activates the selected ones of the ink drop generators $\mathbf{32}_1$–$\mathbf{32}_M$.

Since the load trigger bit from the Nth bit register initiates the loading of the print data into the data latches $L_1$–$L_{N-1}$, there is no need for a second clock signal for this purpose. Thus, the present invention eliminates the need for a second clock line passing from the printer to the print cartridge, and from the print cartridge to the print head. This not only reduces fabrication costs of the print head and cartridge, but also reduces EMI which could be introduced by a second clock line.

To prevent uncontrolled self-latching, the shift register 14 is cleared between each data segment. The logic circuit 20 provides this clear signal based on the state of the clear input CL connected to the line 18, and based on the delayed load trigger signal on the line 28. Once cleared, the shift register 14 is ready for the next segment of print data in the serial data stream.

It is contemplated, and will be apparent to those skilled in the art from the preceding description and the accompanying drawings that modifications and/or changes may be made in the embodiments of the invention. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. A print data loading circuit for receiving at least N bits of serial data on a serial input data line, at least some of the bits of serial data describing an image to be formed on a print medium by a printing device, the loading circuit for providing the print data to a data bus in an addressing circuit, where the addressing circuit addresses one or more image-forming elements in the printing device, the circuit comprising:

an N-bit serial shift register including:

a first single-bit storage register having:

a first-register data input coupled to the serial input data line;

a first-register data output; and a first-register clock input coupled to a clock line;

an Nth single-bit storage register having:

an Nth-register data input;

an Nth-register data output; and an Nth-register clock input coupled to the clock line; and N−2 number of single-bit storage registers serially coupled between the first and Nth single-bit storage registers, each having a data input and a data output;

a first buffer circuit having an input and an output, the input of the first buffer circuit connected to the Nth register data output;

N−1 number of data latches having:

data-latch inputs coupled to the data outputs of the first single-bit storage register and the N−2 number of single-bit storage registers serially coupled between the first and Nth single-bit storage registers;

data-latch outputs coupled to N−1 number of selection lines that are coupled to the data bus; and data-latch clock inputs coupled to the output of the first buffer circuit, a clear input line;

a logic circuit having a first input connected to the clear input line, a second input connected to the output of the first buffer circuit, and a logic circuit output;

the N−1 number of data latches each including a data-latch clear input coupled to the clear input line; and the single-bit storage registers of the N-bit serial shift register each including a storage register clear input coupled to the logic circuit output, where a bit provided from the Nth-register data output, through the first buffer circuit, and to the data-latch clock inputs causes at least some of the other data bits in the first and the N−2 number of single-bit storage registers to be transferred from their data outputs to the data-latch inputs of corresponding ones of the N−1 number of data latches, the first buffer circuit providing a time delay between the Nth-register data output and the data-latch clock inputs.

2. The print data loading circuit of claim 1 wherein the logic circuit comprises:

a NOR gate having first and second inputs, and having an output connected to the storage register clear inputs;

a second buffer circuit having an input connected to the output of the first buffer circuit and an output connected to the first input of the NOR gate; and a logic inverter having an input connected to the clear input line and an output connected to the second input of the NOR gate.

3. The print data loading circuit of claim 1 wherein the single-bit storage registers of the N-bit serial shift register each comprise a flip-flop circuit.

4. An ink jet print head for printing an image on a print medium, the print head comprising:

a plurality of ink droplet generators for ejecting droplets of ink onto a print medium based at least in part upon selection signals;

at least N−1 number of selection lines coupled to one or more of the ink droplet generators, the selection lines for carrying the selection signals;

a serial data input line for receiving serial data describing the image to be printed on the print medium, where the serial data includes at least N number of serial data bits in a data segment;

a clock line for receiving a clock signal;

an N-bit serial shift register including:

a first single-bit storage register having:

a first-register data input coupled to the serial input data line;

a first-register data output; and a first-register clock input coupled to the clock line;

an Nth single-bit storage register having:

an Nth-register data input;

an Nth-register data output; and an Nth-register clock input coupled to the clock line; and N−2 number of single-bit storage registers serially coupled between the first and Nth single-bit storage registers;

a first buffer circuit having an input and an output, the input of the first buffer circuit connected to the Nth register data output;

N−1 number of data latches having:

data-latch inputs coupled to the data outputs of the first single-bit storage register and the N−2 number of single-bit storage registers serially coupled between the first and Nth single-bit storage registers;

data-latch outputs coupled to N−1 number of selection lines; and data-latch clock inputs coupled to the output of the first buffer circuit, a clear input line;

a logic circuit having a first input connected to the clear input line, a second input connected to the output of the first buffer circuit, and a logic circuit output;

the N−1 number of data latches each including a data-latch clear input coupled to the clear input line; and the single-bit storage registers of the N-bit serial shift register each including a storage register clear input coupled to the logic circuit output, where a bit provided from the Nth-register data output, through the first buffer circuit, and to the data-latch clock inputs causes at least some of the other serial data bits in the first and the N−2 number of single-bit storage registers to be transferred from their data outputs to the data-latch inputs of corresponding ones of the N−1 number of data latches, the first buffer circuit providing a time delay between the Nth-register data output and the data-latch clock inputs.

5. The ink jet print head of claim 4 wherein the logic circuit comprises:

a NOR gate having first and second inputs, and having an output connected to the storage register clear inputs;

a second buffer circuit having an input connected to the output of the first buffer circuit and an output connected to the first input of the NOR gate; and a logic inverter having an input connected to the clear input line and an output connected to the second input of the NOR gate.

6. The ink jet print head of claim 4 wherein the single-bit storage registers of the N-bit serial shift register each comprise a flip-flop circuit.

7. A method for providing print data to an ink droplet generator addressing circuit in an ink jet print head based on serial input data, the method comprising:

(a) shifting N−1 of N number of bits of the serial input data into an N-bit serial shift register, where a first bit of the N number of bits that is shifted into the shift register is a load trigger bit;

(b) shifting an Nth bit of the N number of bits into the shift register, thereby causing the load trigger bit to be shifted into an Nth register of the shift register;

(c) after a predetermined time delay, providing the load trigger bit from the Nth register of the shift register to clock inputs of N−1 number of data latches;

(d) loading the N−1 number of data latches with the N−1 number of bits of data residing in the shift register when the load trigger bit is provided to the clock inputs of the data latches;

(e) providing the N−1 number of bits of data from the N−1 number of data latches to the ink droplet generator addressing circuit;

(f) after a predetermined time delay, providing the load trigger bit from the Nth register of the shift register to a trigger input of a logic circuit;

(g) providing a clear bit to a clear input of the logic circuit; and (h) upon the occurrence steps (f) and (g), providing a clear signal from an output of the logic circuit to the N-bit serial shift register, thereby clearing the N bits of the N-bit serial shift register.

8. The method of claim 7 wherein the step of providing the N−1 number of bits of data from the N−1 number of data latches to the ink droplet generator addressing circuit further comprises providing the N−1 number of bits of data to a corresponding number of selection lines coupled to the addressing circuit.

9. A print data loading circuit for receiving at least N bits of serial data on a serial input data line, at least some of the bits of serial data describing an image to be formed on a print medium by a printing device, the loading circuit for providing the print data to a data bus in an addressing circuit, where the addressing circuit addresses one or more image-forming elements in the printing device, the circuit comprising:

an N-bit serial shift register including:

a first single-bit storage register having:

a first-register data input coupled to the serial input data line;

a first-register data output; and a first-register clock input coupled to a clock line;

an Nth single-bit storage register having:

an Nth-register data input;

an Nth-register data output; and an Nth-register clock input coupled to the clock line; and N−2 number of single-bit storage registers serially coupled between the first and Nth single-bit storage registers, each having a data input and a data output;

N−1 number of data latches having:

data-latch inputs coupled to the data outputs of the first single-bit storage register and the N−2 number of single-bit storage registers serially coupled between the first and Nth single-bit storage registers;

data-latch outputs coupled to N−1 number of selection lines that are coupled to the data bus; and data-latch clock inputs coupled to the Nth register data output, a clear input line;

a logic circuit having a first input connected to the clear input line, a second input connected to the Nth register data output, and a logic circuit output;

the N−1 number of data latches each including a data-latch clear input coupled to the clear input line; and the single-bit storage registers of the N-bit serial shift register each including a storage register clear input coupled to the logic circuit output, where a bit provided from the Nth-register data output to the data-latch clock inputs causes at least some of the other data bits in the first and the N−2 number of single-bit storage registers to be transferred from their data outputs to the data-latch inputs of corresponding ones of the N−1 number of data latches.

* * * * *

UNITED STATES PATENT AND TRADEMARK OFFICE

CERTIFICATE OF CORRECTION

PATENT NO. : 6,547,356 B2
DATED : April 15, 2003
INVENTOR(S) : Edelen et al.

It is certified that error appears in the above-identified patent and that said Letters Patent is hereby corrected as shown below:

Column 4,
Line 47, after "CL", delete the words "connected to the line 18".

Signed and Sealed this

Twenty-first Day of October, 2003

JAMES E. ROGAN
*Director of the United States Patent and Trademark Office*